US011548044B2

(12) United States Patent
Opitz et al.

(10) Patent No.: US 11,548,044 B2
(45) Date of Patent: Jan. 10, 2023

(54) COOLING OF FLAT ROLLED MATERIAL WITHOUT POST-RUNNING OF THE HEADER

(71) Applicant: Primetals Technologies Austria GmbH, Linz (AT)

(72) Inventors: Erich Opitz, Linz (AT); Lukas Pichler, Linz (AT); Florian Poeschl, Linz (AT); Alois Seilinger, Linz (AT); Klaus Weinzierl, Nuremberg (DE)

(73) Assignee: Primetals Technologies Austria GmbH, Linz (AT)

( * ) Notice: Subject to any disclaimer, the term of this patent is extended or adjusted under 35 U.S.C. 154(b) by 0 days.

(21) Appl. No.: 17/440,938

(22) PCT Filed: Mar. 13, 2020

(86) PCT No.: PCT/EP2020/056872
§ 371 (c)(1),
(2) Date: Sep. 20, 2021

(87) PCT Pub. No.: WO2020/187749
PCT Pub. Date: Sep. 24, 2020

(65) Prior Publication Data

US 2022/0088658 A1 Mar. 24, 2022

(30) Foreign Application Priority Data

Mar. 18, 2019 (DE) ..... 10 2019 106 730.8

(51) Int. Cl.
*B21B 45/02* (2006.01)
*B05C 11/10* (2006.01)
(Continued)

(52) U.S. Cl.
CPC ..... *B21B 45/0218* (2013.01); *B05C 11/1002* (2013.01); *B21B 45/0233* (2013.01);
(Continued)

(58) Field of Classification Search
CPC ... B05C 11/1002; B05C 5/02; B21B 45/0218; B21B 45/0233; C21D 11/005; B05B 1/30
(Continued)

(56) References Cited

U.S. PATENT DOCUMENTS 4,440,584 A * 4/1984 Takeshige ..... B21B 45/0233 72/201
4,497,180 A * 2/1985 Graham ..... B21B 45/0233 134/122 R
(Continued)

FOREIGN PATENT DOCUMENTS

CN 207592446 U 7/2018
DE 3230866 A1 4/1983
(Continued)

OTHER PUBLICATIONS

International Search Report and Written Opinion received in International Application No. PCT/EP2020/056872 dated Jul. 1, 2020, pp. 14.
(Continued)

*Primary Examiner* — Jessee R Roe
*Assistant Examiner* — Michael Aboagye
(74) *Attorney, Agent, or Firm* — Liang & Hennessey LLP; Brian Hennessey

(57) ABSTRACT

Device for cooling flat rolled material with a liquid coolant has at least one cooling bar, which is arranged above the conveying path and to which the liquid coolant is fed. A plurality of outlet tubes have, in a flow direction of the liquid coolant, an initial portion, which proceeds from the inlet opening and extends upward, a middle portion, which adjoins the initial portion, and an end portion, which adjoins the middle portion and extends downward and to the output opening. The middle portion contains a vertex at which the coolant flowing through the outlet tube in question reaches
(Continued)

a highest point. The outlet openings are located above the cooling bar. A height distance (h1) of the inlet opening from the vertex is at least twice as large, in particular at least three times as large, as a height distance (h2) of the outlet opening from the vertex.

11 Claims, 3 Drawing Sheets

(51) Int. Cl.
*C21D 11/00* (2006.01)
*B05B 1/30* (2006.01)
*B05C 5/02* (2006.01)

(52) U.S. Cl.
CPC ..... *C21D 11/005* (2013.01); *B05B 1/30* (2013.01); *B05C 5/02* (2013.01)

(58) Field of Classification Search
USPC ..... 266/46, 111, 113, 114
See application file for complete search history.

(56) References Cited

U.S. PATENT DOCUMENTS 7,523,631 B2 * 4/2009 Fujibayashi ..... B21B 45/0233 72/201
8,349,247 B2 * 1/2013 Ueno ..... B21B 45/0233 266/46
9,643,224 B2 * 5/2017 Breuer ..... B21B 45/0209
9,833,822 B2 * 12/2017 Ueoka ..... B21B 45/0233

FOREIGN PATENT DOCUMENTS

DE 19843038 A1 3/2000
DE 2777835 * 9/2014 ..... B21B 45/0218
JP H01139913 U 9/1989
JP H0459115 * 2/1992 ..... B21B 45/0233

OTHER PUBLICATIONS

Third Party Observation received in European Application No. EP20200711872 dated Sep. 6, 2022, pp. 14.
indiamart.com "Laminar Cooling Heater", www.indiamart.com/proddeta/laminar-cooling-header-14422806630.html, Jan. 2018, pp. 1-2.
Maierl, Josef et al; "Advanced Strip Cooling Solutions for Hot-strip Mills-Mechanical Actuators, Microstructure Monitor for Online Conrol of Strip Properties"; Electric and Automotion Hot-Strip Mills, Siemens AG Erlangen, Jan. 2011, pp. 1-8.
Weinzierl, Klaus "New cooling control enables conventional mills to manufacture multiphase steels"; Siemens AG, Industrial Solutions & Services; Metals Technology Erlangen Germany, Feb. 2006, pp. 1-5.
SMS Demag Aktiengesellschaft; "Brochure, Die Kompakt-Warmbandstraße der Saudi Iron & Steel"; Geschäftsbereich Warmflachwalzwerk, Apr. 2002, pp. 1-6.

* cited by examiner

COOLING OF FLAT ROLLED MATERIAL WITHOUT POST-RUNNING OF THE HEADER

CROSS-REFERENCE TO RELATED APPLICATIONS

The present application is a national phase application of PCT Application No. PCT/EP2020/056872, filed Mar. 13, 2020, entitled "COOLING OF FLAT ROLLED MATERIAL WITHOUT POST-RUNNING OF THE HEADER", which claims the benefit of German Patent Application No. 102019106730.8, filed Mar. 18, 2019, each of which is incorporated by reference in its entirety.

BACKGROUND OF THE INVENTION

1. Field of the Invention

The present invention is based on an apparatus for cooling flat metal rolling stock with a liquid coolant, wherein the flat rolling stock is conveyed on a conveying path in a transport direction, wherein the apparatus has at least one cooling bar which is arranged above the conveying path and to which the liquid coolant is fed via a supply line, wherein the cooling bar extends substantially transversely to the transport direction and has a plurality of outlet tubes, wherein the outlet tubes each have an inlet opening and an outlet opening, wherein the liquid coolant enters the respective outlet tube from the cooling bar via the respective inlet opening and exits the respective outlet tube via the respective outlet opening, wherein the respective outlet tube has, as seen in a flow direction of the liquid coolant, an upwardly running start portion which originates from the inlet opening, a middle portion adjoining thereto and a downwardly running end portion adjoining thereto which extends as far as the outlet opening, such that the middle portion contains an apex at which the coolant flowing through the respective outlet tube reaches a highest point.

2. Description of the Related Art

An apparatus of this kind is known, for example, from DE 199 34 557 A1 and also from DE 10 2010 049 020 A1.

In the cooling section of a rolling mill, flat metallic rolling stock is cooled after rolling. The flat rolling stock may be composed of steel or aluminum, for example. Depending on requirements, this may be a strip or a plate. Exact temperature control in the cooling section is customary in order to set desired material properties and to keep them constant with a relatively low degree of scatter. For this purpose, particularly in the case of a cooling section arranged downstream of the rolling mill, a plurality of cooling bars are installed along the cooling section, by means of which cooling bars a liquid coolant, usually water, is applied at least from above, often from above and from below, to the flat rolling stock in order to cool the hot rolling stock.

In the case of the cooling bars of DE 199 34 557 A1, there occurs, as embodied correctly in DE 10 2010 049 020 1, the effect that the cooling bar is evacuated by suction via the outlet tubes in accordance with the principle of a siphon when the coolant supply is deactivated. During this period of time, the coolant exits the outlet tubes in an uncontrolled manner and thus leads to uncontrolled cooling of the flat rolling stock and the associated disadvantageous effects.

In DE 10 2010 049 020 A1, this effect is indeed avoided. This is achieved in DE 10 2010 049 020 A1 in that each individual outlet tube is assigned a dedicated valve for opening and closing the respective outlet tube. Although this solution therefore prevents the cooling bar from being evacuated by suction, it is very expensive. Furthermore, only simple switching of the outlet tubes (completely open or completely closed) is possible, not continuous control.

A further solution consists in configuring the outlet tubes as straight tubes which protrude from below into the cooling bar and which there reach a considerable height such that they terminate in the upper region of the cooling bar. In this solution, however, there is also an appreciable follow-on flow of coolant when the cooling bar is deactivated. This solution leads to good results only in the case of intensive cooling, in which work is performed at high pressures.

SUMMARY OF THE INVENTION

The object of the present invention is to provide options which can be used to limit the follow-on flow of coolant to an unavoidable minimum using simple measures.

The object is achieved by an apparatus having the features of the claims. Advantageous refinements of the apparatus are the subject matter of the dependent claims.

According to the invention, an apparatus of the type mentioned in the introduction is designed in that the outlet openings are located above the cooling bar, and in that a height distance of the inlet opening from the apex is at least two times as great, in particular at least three times as great, as a height distance of the outlet opening from the apex.

The invention is based on the knowledge that although there is a state of equilibrium immediately after the supply of coolant to the cooling bar has been deactivated, this state of equilibrium is unstable. In the case of the smallest disturbance of this state of equilibrium—and such disturbances always occur in practice—the liquid coolant runs out of some of the outlet tubes, while air is drawn in via the other outlet tubes. The quantities of liquid coolant moving in the outlet tubes as a result are initially accelerated. The acceleration increases until the air drawn in via the other outlet tubes reaches the apex of the respective outlet tube. Thereafter, the moving quantities of liquid coolant are accelerated further. However, the extent of the acceleration decreases. The acceleration reaches the value zero when the drawn-in air in the start portion reaches the same height as the outlet opening of the respective outlet tube. This level represents a further state of equilibrium which is however stable in contrast to the first-mentioned state of equilibrium.

Since, however, the quantities of coolant located in the outlet tubes are already moving at a certain speed at this point in time, the movement of the coolant continues beyond this stable state of equilibrium. The quantities of liquid coolant moving in the outlet tubes are now decelerated, however. If the height by which the apex of the respective outlet tube lies above the outlet opening of the respective outlet tube is denoted by h, a height position at which the quantities of liquid coolant moving in the outlet tubes come to rest (provisionally) is approximately 1.5 h below the outlet opening of the respective outlet tube, but at most 2 h below the outlet opening of the respective outlet tube. This is followed by a return swing owing to the exceedance of the stable equilibrium position.

If the inlet openings of the outlet tubes lie above the stated level of approximately 1.5 h or of 2 h below the outlet opening of the respective outlet tube, air can enter the cooling bar as a result. This leads to an increased follow-on flow of the coolant. If, by contrast, the inlet openings of the outlet tubes lie at least at or below the stated level of approximately 1.5 h or of 2 h below the outlet opening of the respective outlet tube, the fluctuations remain restricted to the quantities of coolant located in the outlet tubes. Only these very marginal quantities may still continue to flow.

The above specifications of approximately 1.5 h and at most 2 h apply for the assumption that the movement of the coolant in the outlet tubes takes place without any appreciable friction losses. However, such friction losses are present in practice. Said friction losses therefore reduce the extent to which the coolant in the outlet tubes is accelerated and increase the extent to which the coolant in the outlet tubes is decelerated. In practice, it can therefore often be sufficient if a height distance of the inlet opening from the apex is (only) two times as great as the height distance of the outlet opening from the apex.

Preferably, the outlet tubes are placed onto the top side of the cooling bar. As a result, the condition that the outlet openings be located above the cooling bar can be achieved in a particularly simple manner and in particular with a relatively small overall height of the cooling bar, including outlet tubes.

Preferably, the start portions of the outlet tubes protrude at least partially into the cooling bar. As a result, the overall height of the cooling bar, including outlet tubes, can be kept as small as possible.

Preferably, the start portions run vertically. As a result, a particularly simple construction is produced.

Preferably, the middle portions are curved and each extend over a curvature angle of 150° to 180°. As a result, a laminar, virtually turbulence-free flow can still be obtained in a simple manner in spite of the reversal of direction of the movement of the coolant in the outlet tubes.

Preferably, the length of the end portion is 0. As a result, the overall height of the cooling bar, including outlet tubes, can be kept as small as possible.

Preferably, the outlet tubes each have—in particular in the region of their inlet openings—a flow resistor. As a result, in particular the vertical length of the start portions can be kept small.

Preferably, the respective flow resistor is releasably connected to the respective outlet tube. As a result, on the one hand, the flow resistor can also be adapted subsequently as required. Furthermore, the flow resistors can also be exchanged if, after a relatively long period of operation, they become calcified or clogged in some other way.

It is possible that the outlet tubes have—in particular in their middle portions—ventilation bores. However, this is generally not necessary.

BRIEF DESCRIPTION OF THE DRAWINGS

The above-described properties, features and advantages of this invention and the manner in which they are achieved become more clearly and distinctly comprehensible in conjunction with the following description of the exemplary embodiments which are explained in more detail in connection with the schematically represented drawings, in which.

DETAILED DESCRIPTION

Figure 1:
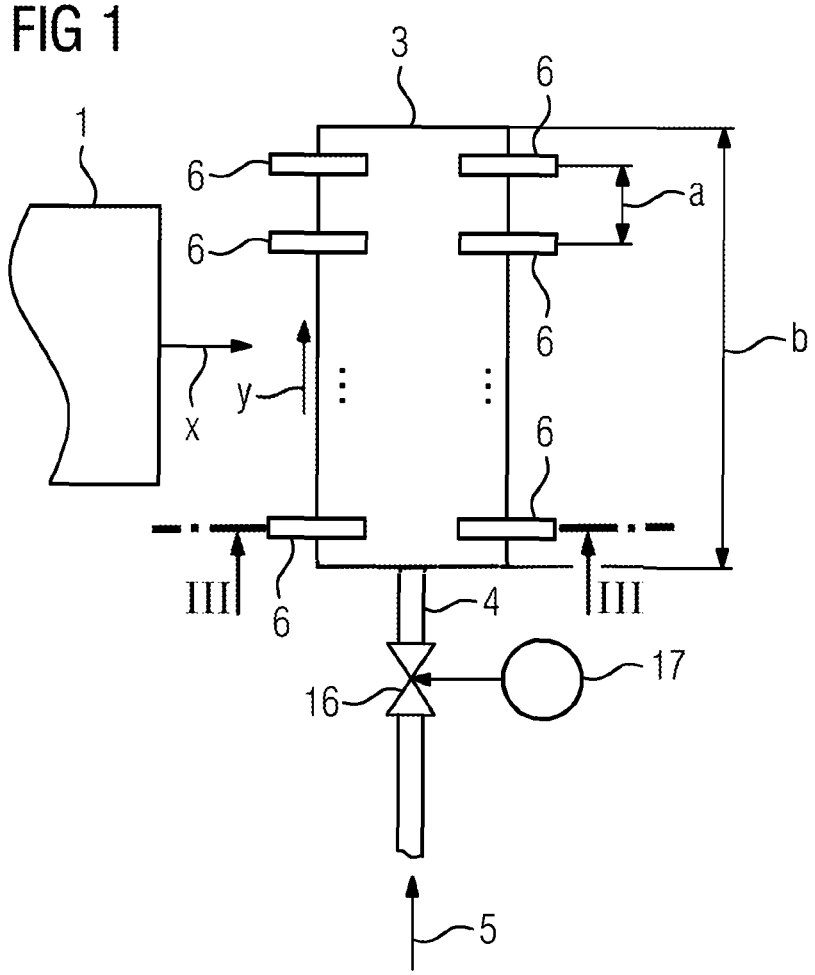
FIG. 1 shows a portion of a cooling section from above.
Figure 2:
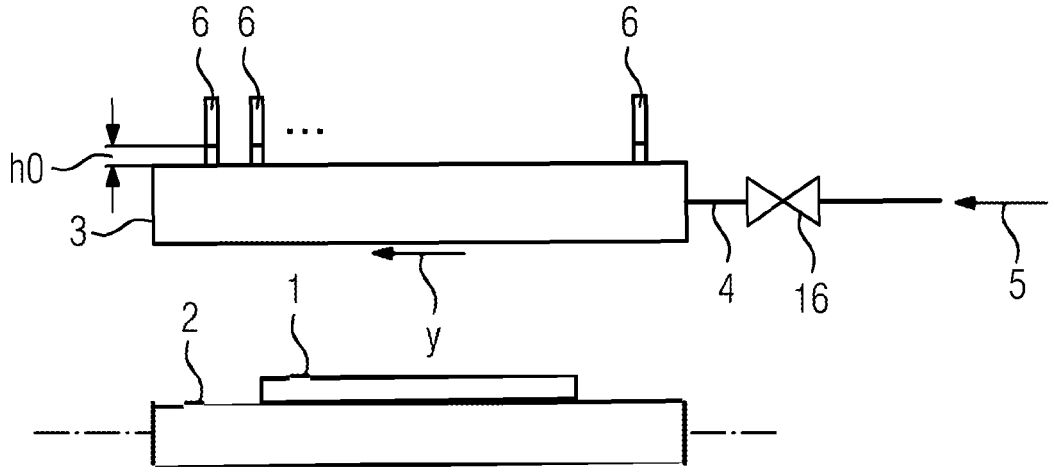
FIG. 2 shows the cooling bar of FIG. 1 from the front.
Figure 3:
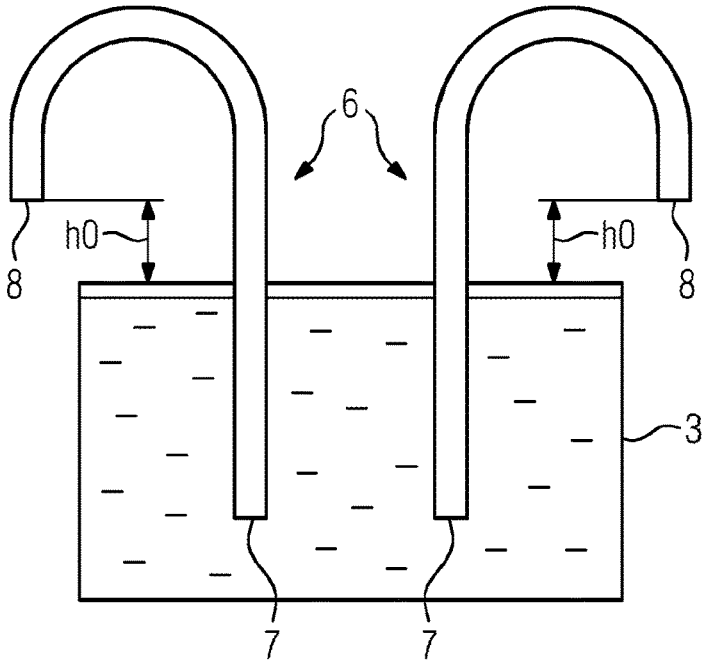
FIG. 3 shows a section through the cooling bar of FIG. 1 along a line in FIG. 1.

As per FIGS. 1 to 3, flat rolling stock 1 is intended to be cooled in a cooling section. The flat rolling stock 1 is composed of metal, wherein the term "metal" in the context of the present invention is intended to also encompass common, widely used alloys. For example, the flat rolling stock 1 may be composed of steel or aluminum. The flat rolling stock 1 may for example be a strip or a plate. The cooling section may be arranged, for example, on the run-out side of a multi-stand finishing mill train.

The flat rolling stock 1 is conveyed in a transport direction x through the cooling section. For this purpose, the cooling section has a conveying path on which the flat rolling stock 1 is conveyed. For reasons of clarity, only one of the transport rolls 2 of the conveying path is illustrated, and this is also only in FIG. 2.

In order to cool the flat rolling stock 1, at least one cooling bar 3 is present. The cooling bar 3 is arranged above the conveying path. A liquid coolant 5, with which the flat rolling stock 1 is intended to be cooled, is fed to the cooling bar 3 via a supply line 4. For the sake of good order, it should be mentioned that cooling bars may also be arranged below the cooling section, by means of which cooling bars the liquid coolant 5 is applied from below to the flat rolling stock 1. However, insofar as the mechanical design configuration of the cooling bars 3 is concerned, these cooling bars are not the subject matter of the present invention. The following statements regarding the mechanical design configuration of the cooling bars 3 therefore always refer to the cooling bar 3 above the conveying path.

The cooling bar 3 extends substantially transversely to the transport direction x, that is to say in a transverse direction y. The width b of the cooling bar 3 in the transverse direction y is generally between 1 m and 2 m. However, it can also be greater or smaller than that. For example, cooling sections are provided downstream of so-called medium-wide strip mill trains or in rolling mill trains for aluminum. In such cases, the width b in some cases may be only 30 cm or slightly more than that. There are for example also heavy-plate mill trains in which the width b of the cooling section may be up to 4 m. As a rule, the liquid coolant 5 is water or is composed at least substantially of water (proportion of at least 98%). A pressure with which the coolant 5 is fed to the cooling bar 3 is generally between 0 bar and 2 bar, usually approximately 0.8 bar. The cooling bar 3 is a laminar cooling bar in this case.

The cooling bar 3 has a plurality of outlet tubes 6. The outlet tubes 6 each have an inlet opening 7 and an outlet opening 8. The outlet openings 8 are located above the cooling bar 3, i.e. above the uppermost point of the cooling bar 3. A height distance h0 of the outlet openings 8 from the top side of the cooling bar 3 should be at least 5 cm.

Figure 5:
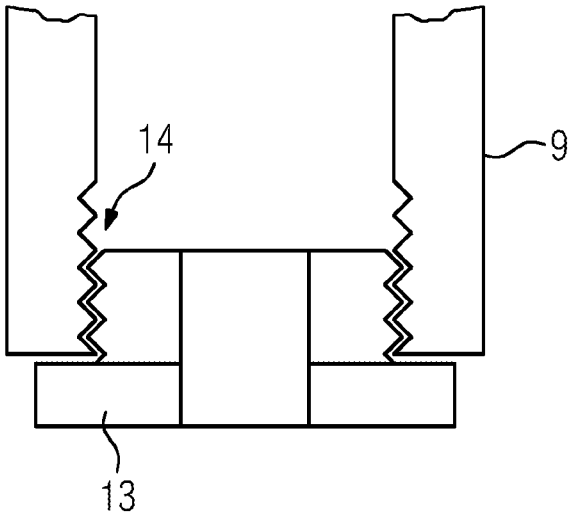
FIG. 5 shows a start portion of an outlet tube in cross section.

The outlet tubes 6 usually form two rows, wherein the two rows extend in the transverse direction y. However, in some cases, also only a single row is present or more than two rows are present. If a plurality of rows are present, the rows are spaced apart from one another in the transport direction x. There are always a plurality of outlet tubes 6 within the respective row. In many cases, at least 10, sometimes even 20, outlet tubes 6 and more are present. A distance between the outlet tubes 6 (measured from the center of the outlet opening 8 to the center of the outlet opening 8 of the next outlet tube 6) is generally between approximately 4 cm and 5 cm. An inner diameter d of the outlet tubes 6—see in particular FIG. 5—is generally between approximately 10 mm and approximately 20 mm.

The outlet tubes 6 are generally configured in a similar manner Therefore, only a single one of the outlet tubes 6 is explained in more detail below with reference to FIG. 4. On account of the similar configuration, analogous statements apply to the other outlet tubes 6.

Figure 4:
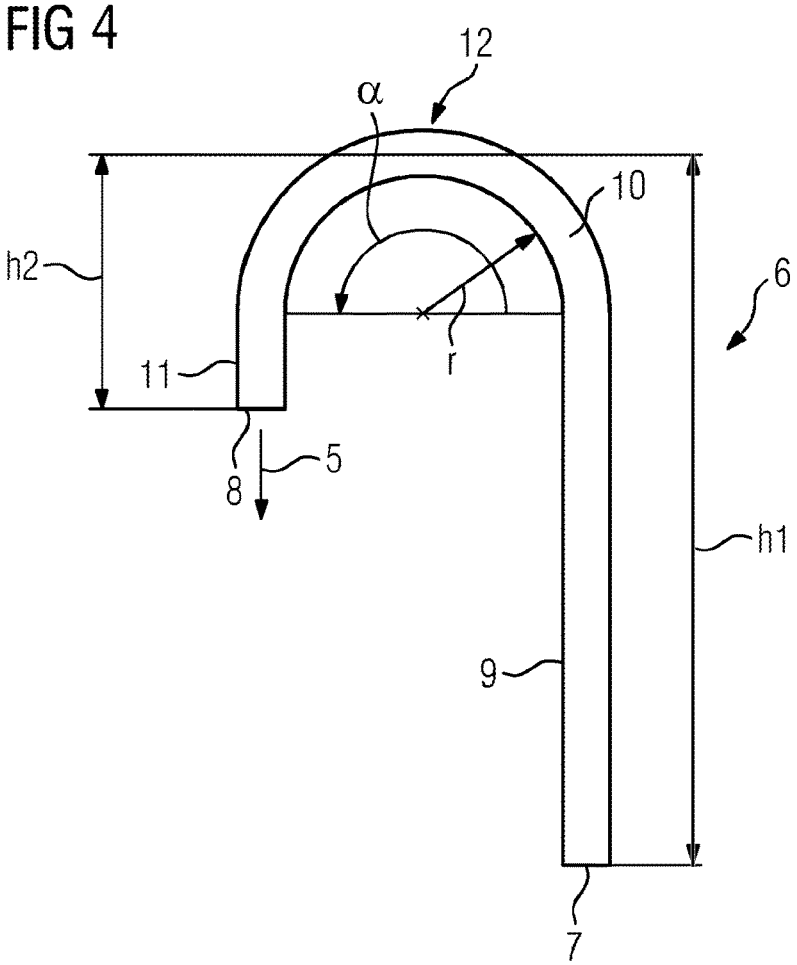
FIG. 4 shows a section through an individual outlet tube.

As per FIG. 4, the outlet tube 6 is configured in such a way that the liquid coolant 5 enters the respective outlet tube 6 from the cooling bar 3 via the inlet opening 7 of the outlet tube 6. In the simplest case, entry takes place directly from below. Proceeding from the inlet opening 7, the coolant 5 flows upward in a start portion 9. The start portion 9 may run vertically, in particular.

The start portion 9 is adjoined by a middle portion 10. In the middle portion 10, the liquid coolant 5 is redirected such that it flows—completely or at least substantially—downward. In particular, the middle portion 10 may be curved with a uniform radius of curvature r, wherein the curvature angle $\alpha$ covered by the middle portion 10 is generally at least 150° and at most 180°.

The middle portion 10 is adjoined by an end portion 11. The end portion 11 extends as far as the outlet opening 8. In the end portion 11, the liquid coolant 5 flows downward, and vertically downward in the ideal case. The coolant 5 then exits the outlet tube 6 in a downward direction and falls from above onto the flat rolling stock 1.

The end portion 11 may be longer or shorter. The shorter the end portion 11 can be kept, the better. In the extreme case, the length of the end portion 11 may be 0, such that the end portion 11 is consequently omitted. This consequently means that the outlet opening 8 may directly adjoin the middle portion 10. This is not critical in this respect because the coolant 5 already flows from top to bottom in that region of the middle portion 10 which is remote from the start portion 9.

On account of the structural design of the outlet tube 6, the middle portion 10 contains an apex 12 at which the coolant 5 flowing through the outlet tube 6 reaches a highest point. The coolant 5 flows horizontally at the apex 12. The apex 12 may correspond, for example, to the lowermost point of the inner cross section of the outlet tube 6 at this point, to the uppermost point of the inner cross section of the outlet tube 6 at this point, or to a point in between—in particular in the middle.

Both the inlet opening 7 and the outlet opening 8 are located below the apex 12. A height distance h1 of the inlet opening 7 from the apex 12 is greater than a height distance h2 of the outlet opening 8 from the apex 12. In particular, the height distance h1 is at least two times as great as the height distance h2, for example 2.5 times as great. It is preferably at least three times as great.

The outlet tubes 6 are not only of similar configuration but also arranged in a uniform manner. The wording "arranged in a uniform manner" is intended in this context to mean that the apexes 12 lie at a uniform height level, that the height distances h1 are equal to one another and that the height distances h2 are equal to one another. The inlet openings 7 thus also lie at a uniform height level. The same applies to the outlet openings 8. For example, the apexes 12 may lie approximately 15 cm above the upper edge of the cooling bar 3, the outlet openings 8 approximately 7.5 cm above the upper edge of the cooling bar 3 and the inlet openings 7 approximately 15 cm below the upper edge of the cooling bar 3. However, the stated numerical values are to be understood as purely exemplary. If the stated numerical values are implemented, the ratio of the height distances h1, h2 to one another is furthermore 4:1.

Correspondingly to the illustration in FIGS. 1 to 3, the outlet tubes 6 are placed onto the top side of the cooling bar 3. The wording "placed onto the top side" is intended here to mean that the outlet tubes 6 enter the cooling bar 3 from above. By contrast, this is not intended to mean that the outlet tubes 6 terminate on the top side of the cooling bar 3. Although this is possible, it is preferred, correspondingly to the illustration in FIG. 3, that the start portions 9 of the outlet tubes 6 protrude at least partially into the cooling bar 3. Specifically, the outlet tubes 6 should protrude as far as possible into the cooling bar 3. This applies in particular because it makes it possible to maximize the ratio of the height distances h1, h2 to one another, without increasing the overall height of the cooling bar 3, including the outlet tubes 6.

It is possible that the outlet tubes 6 have a uniform cross section over their entire extent, that is to say from the start portion 9 up to the end portion 11. It is alternatively possible that the outlet tubes 6 each have a flow resistor 13, correspondingly to the illustration in FIG. 5. The flow resistor 13 acts individually for the respective outlet tube 6. It reduces the available cross section of the respective outlet tube 6. For example, the available cross section of the respective outlet tube 6 in the region of the flow resistor 13 may be between 20% and 80% of the cross section of the respective outlet tube 6 in the remaining region. The cross section which remains in the region of the flow resistor 13 is usually between 40% and 60% of the cross section in the remaining region of the respective outlet tube 6. The flow resistor may be arranged in particular in the region of the inlet openings 7 of the outlet tubes 6, correspondingly to the illustration in FIG. 5.

The respective flow resistor 13 is preferably releasably connected to the respective outlet tube 6. For example, correspondingly to the illustration in FIG. 5, the respective flow resistor 13 may be connected to the respective outlet tube 6 by means of a screw connection 14, in particular may be screwed into the respective outlet tube 6.

Figure 6:
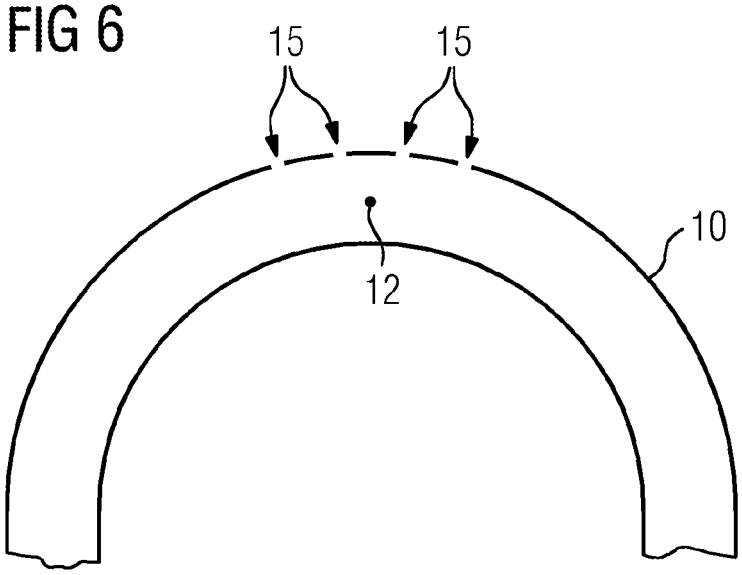
FIG. 6 shows a middle portion of an outlet tube.

The outlet tubes 6 are generally closed—with the exception of the respective inlet opening 7 and the respective outlet opening 8. It is however possible that the outlet tubes 6 have—preferably in their middle portions 10—ventilation bores 15, correspondingly to the illustration in FIG. 6. If they are present, the ventilation bores 15 are arranged on the top side of the middle portions 10 and preferably in the vicinity of the respective apex 12. However, as a rule, the ventilation bores 15 are not necessary.

Correspondingly to the illustration in FIGS. 1 and 2, a control valve 16 is arranged in the supply line 4. The control valve 16 can be used to adjust the quantity of liquid coolant 5 fed to the cooling bar 3. Correspondingly to the illustration in FIG. 1, an actuating device 17 is assigned to the control valve 16. The actuating device 17 can be used to transfer the control valve 16 from the completely open position into the completely closed position and vice versa.

The present invention has many advantages. What is achieved in particular is that after the supply of coolant 5 to the cooling bar 3 has been turned off, only the quantity of coolant 5 already located in the outlet tubes 6 can run out of the outlet tubes 6. In practice, this quantity is usually at most 11 and thus a full order of magnitude (i.e. a factor of 10) smaller than in the prior art. Furthermore, it is not possible for any air to pass from the surroundings into the cooling bar 3. The quantity of coolant 5 fed to the cooling bar 3 can be adjusted in a very precise manner Although the invention has been illustrated and described in more detail on the basis of the preferred exemplary embodiment, the invention is not restricted by the examples disclosed, and other variants may be derived herefrom by a person skilled in the art without departing from the scope of protection of the invention.

LIST OF REFERENCE DESIGNATIONS

1 Rolling stock
2 Transport roll
3 Cooling bar
4 Supply line
5 Coolant
6 Outlet tubes
7 Inlet openings
8 Outlet openings
9 Start portion
10 Middle portion
11 End portion
12 Apex
13 Flow resistor
14 Screw connection
15 Ventilation bores
16 Control valve
17 Actuating device
a Distance
b Width
h0, h1, h2 Height distances
r Radius of curvature
x Transport direction
y Transverse direction
α Curvature angle

The invention claimed is:

1. An apparatus for cooling flat metal rolling stock with a liquid coolant, comprising:

at least one cooling bar arranged above a conveying path, the flat rolling stock being conveyed on the conveying path in a transport direction, the at least one cooling bar extending substantially transversely to the transport direction, the at least one cooling bar being fed the liquid coolant via a supply line; and a plurality of outlet tubes of the at least one cooling bar, the outlet tubes each having an inlet opening and an outlet opening, start portions of the outlet tubes protruding at least partially into the cooling bar;

wherein the liquid coolant enters the respective outlet tube from the cooling bar via the respective inlet opening and exits the respective outlet tube via the respective outlet opening;

wherein the respective outlet tube has, as seen in a flow direction of the liquid coolant, an upwardly running start portion which originates from the inlet opening, a middle portion adjoining thereto and a downwardly running end portion adjoining thereto which extends as far as the outlet opening, such that the middle portion contains an apex at which the coolant flowing through the respective outlet tube reaches a highest point; and wherein the outlet openings are located above the cooling bar, and in that a first height distance of the inlet opening from the apex is at least two times as great as a second height distance of the outlet opening from the apex.

2. The apparatus as claimed in claim 1, wherein the first height distance of the inlet opening from the apex is at least three times as great as a second height distance of the outlet opening from the apex.

3. The apparatus as claimed in claim 1, wherein the start portions run vertically.

4. The apparatus as claimed in claim 1, wherein the middle portions of the outlet tubes are curved and each extend over a curvature angle of 150° to 180°.

5. The apparatus as claimed in claim 1, wherein a length of the end portion is 0.

6. The apparatus as claimed in claim 1, wherein the outlet tubes each have a flow resistor.

7. The apparatus as claimed in claim 6, wherein the flow resistor is in a region of the inlet opening.

8. The apparatus as claimed in claim 6, wherein the respective flow resistor is releasably connected to the respective outlet tube.

9. The apparatus as claimed in claim 1, wherein the outlet tubes have ventilation bores.

10. The apparatus as claimed in claim 9, wherein the ventilation bores are in the middle portions.

11. The apparatus as claimed in claim 1, wherein the outlet opening is spaced from the flat metal rolling stock.

* * * * *